US007870817B2

(12) United States Patent
Kawabuchi et al.

(10) Patent No.: US 7,870,817 B2
(45) Date of Patent: Jan. 18, 2011

(54) ACTUATOR USING FLUID CYLINDER AND METHOD OF CONTROLLING THE SAME

(75) Inventors: Ichiro Kawabuchi, Tokyo (JP); Kiyoshi Hoshino, Tsukuba (JP)

(73) Assignee: Japan Science and Technology Agency, Kawaguchi-shi, Saitama (JP)

( * ) Notice: Subject to any disclaimer, the term of this patent is extended or adjusted under 35 U.S.C. 154(b) by 506 days.

(21) Appl. No.: 11/910,116

(22) PCT Filed: Mar. 31, 2006

(86) PCT No.: PCT/JP2006/306968

§ 371 (c)(1),
(2), (4) Date: Sep. 28, 2007

(87) PCT Pub. No.: WO2006/106985

PCT Pub. Date: Oct. 12, 2006

(65) Prior Publication Data

US 2008/0271596 A1 Nov. 6, 2008

(30) Foreign Application Priority Data

Mar. 31, 2005 (JP) ..... 2005-105110

(51) Int. Cl.
*F15B 11/06* (2006.01)
*G05D 16/20* (2006.01)

(52) U.S. Cl. ..... 91/6; 60/461

(58) Field of Classification Search ..... 91/420, 91/433, 444, 449, 468, 407, 6; 60/461, 407, 60/409

See application file for complete search history.

(56) References Cited

U.S. PATENT DOCUMENTS 4,518,011 A * 5/1985 Stoll ..... 91/6
5,775,197 A 7/1998 Kimura
6,662,705 B2 * 12/2003 Huang et al. ..... 60/461

FOREIGN PATENT DOCUMENTS

| | | |
|---|---|---|
| GB | 2 203 195 | 10/1988 |
| JP | 60-116902 | 6/1985 |
| JP | 62-088802 | 4/1987 |
| JP | 62-118103 | 5/1987 |
| JP | 63-211410 | 9/1988 |
| JP | 06-109004 | 4/1994 |
| JP | 09-217704 | 8/1997 |
| JP | 2003-311667 | 11/2003 |
| WO | 02/086327 | 10/2002 |

* cited by examiner

*Primary Examiner*—Thomas E Lazo
(74) *Attorney, Agent, or Firm*—Rankin, Hill & Clark LLP

(57) ABSTRACT

An actuator using a fluid cylinder in which rigidity may be attained with a simple configuration, includes a fluid cylinder, a first choke valve device, and a second choke valve device. The first choke valve device is disposed between a fluid pressure source and a first chamber, and the second choke valve device is disposed between the fluid pressure source and a second chamber. An opening of a valve of a discharge valve mechanism included in each of the choke valve devices is set so as to be in inverse proportion to a target pressure in the chamber in which the fluid pressure is adjusted by the choke valve device.

7 Claims, 9 Drawing Sheets

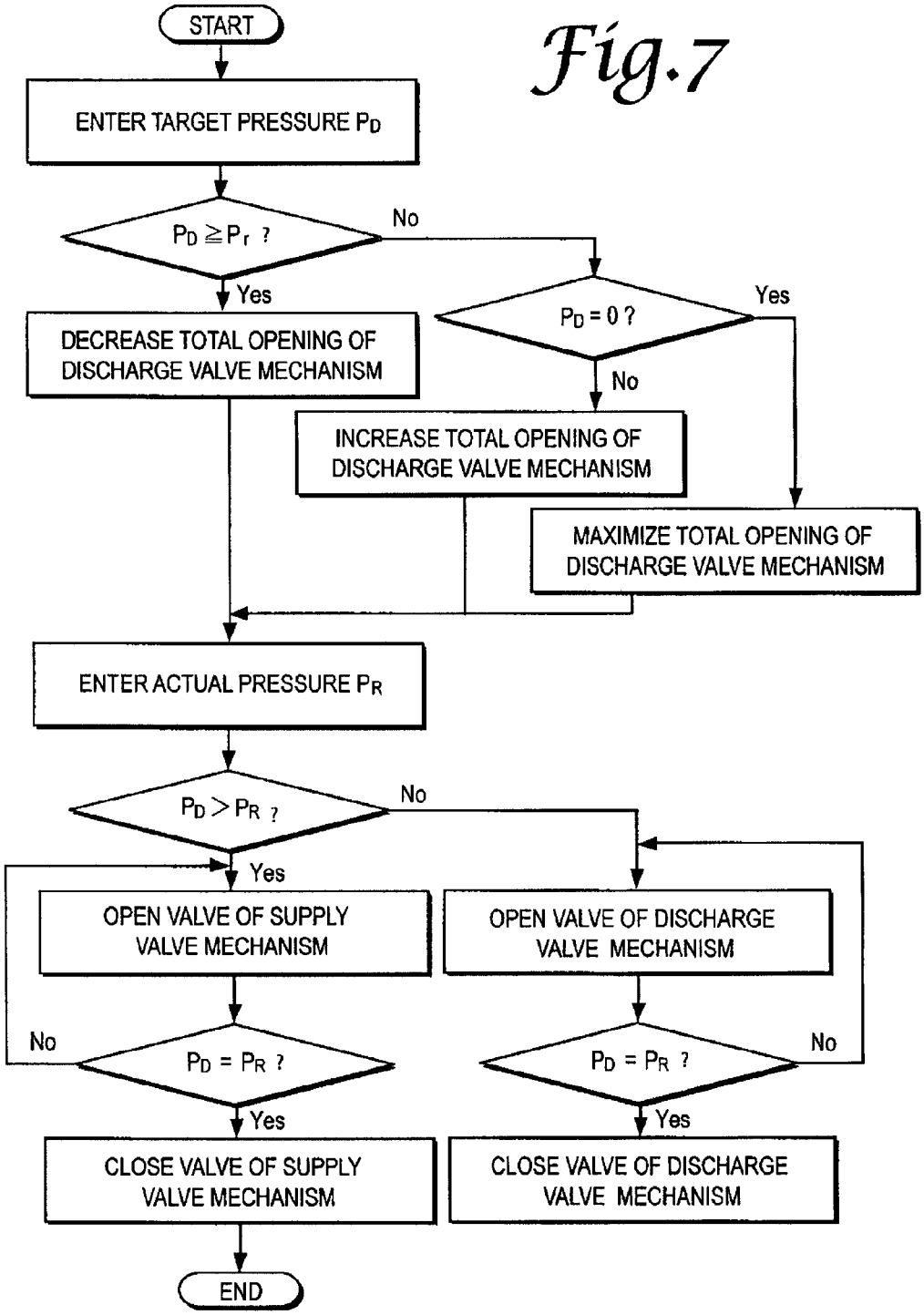
Fig.7
START
ENTER TARGET PRESSURE PD
PD ≧ Pr ?
No
Yes
DECREASE TOTAL OPENING OF DISCHARGE VALVE MECHANISM
PD = 0 ?
Yes
No
INCREASE TOTAL OPENING OF DISCHARGE VALVE MECHANISM
MAXIMIZE TOTAL OPENING OF DISCHARGE VALVE MECHANISM
ENTER ACTUAL PRESSURE PR
PD > PR ?
No
Yes
OPEN VALVE OF SUPPLY VALVE MECHANISM
OPEN VALVE OF DISCHARGE VALVE MECHANISM
No
PD = PR ?
PD = PR ?
No
Yes
Yes
CLOSE VALVE OF SUPPLY VALVE MECHANISM
CLOSE VALVE OF DISCHARGE VALVE MECHANISM
END

ACTUATOR USING FLUID CYLINDER AND METHOD OF CONTROLLING THE SAME

TECHNICAL FIELD

The present invention relates to an actuator using a fluid cylinder, and a method of controlling the same.

BACKGROUND ART

As shown in Japanese Patent Publication No. 2003-311667, an electric motor such as a servomotor is conventionally used as an actuator for moving a joint of a robot. It is because motors are relatively readily available. However, the use of a motor is likely to make the robot larger and heavier. A fluid cylinder such as an air cylinder is lighter and more compact in size than a motor. In addition, the fluid cylinder is simple in structure and maintenance thereof is easy. The motor having such advantages is useful as an actuator for a robot.

DISCLOSURE OF THE INVENTION

Problems to be Solved by the Invention

What most hampers the application of a fluid cylinder such as an air cylinder is difficulty in bringing rigidity into full performance with which a piston becomes hard to move at an arbitrary position. This may be primarily because, unlike the motor, the fluid cylinder is low in responsiveness to force generation, thereby being unable to promptly generate a counteracting force against an external force in order to maintain the position of the piston. To solve this problem, a friction brake, a latch, and the like may be employed. However, it will be more reasonable to employ a motor alone. Therefore, what is needed is to attain the rigidity with as simple a mechanism as possible. However, technology which meets such demand has not been proposed yet.

It is an object of the present invention to provide an actuator using a fluid cylinder that gives rigidity to the fluid cylinder such as an air cylinder with a simple configuration, and a method of controlling the same.

It is another object of the present invention to provide an actuator using a fluid cylinder in which rigidity adjustment is easy.

It is a further object of the present invention to provide an actuator using a fluid cylinder in which rigidity adjustment is possible with a simple structure and component configuration.

Means of Solving the Problems

The present invention is directed to an actuator using a fluid cylinder that has two chambers. In the present invention, an opening of a valve of a discharge valve mechanism for the chamber is set so as to be in inverse proportion to a target pressure for the chamber. If the opening for the discharge valve mechanism is set in this manner, association may be found between the target pressure and a desired rigidity. Thus, rigidity adjustment becomes possible with a few control parameters.

More specifically, the actuator using a fluid cylinder of the present invention comprises a fluid cylinder including a cylinder chamber and a piston slidably disposed in the cylinder chamber so as to partition the cylinder chamber into a first chamber and a second chamber. Here, the fluid cylinder refers to a cylinder, which is activated by means of a fluid pressure as its driving source, such as an air cylinder and an oil cylinder. The actuator using a fluid cylinder of the present invention further comprises a first choke valve device disposed between a fluid pressure source and the first chamber to adjust a fluid pressure in the first chamber, and a second choke valve device disposed between the fluid pressure source and the second chamber to adjust a fluid pressure in the second chamber. Here, the fluid pressure source may be separately arranged for each of the first and second choke valve devices, or one common fluid pressure source may be provided to the first and second choke valve devices. The first choke valve device and the second choke valve device respectively include: a remotely-controllable supply valve mechanism which allows a fluid to flow in an incoming direction from the fluid pressure source to the corresponding chamber; a remotely-controllable discharge valve mechanism which allows the fluid to flow in an outgoing direction from the chamber to the atmosphere or a low pressure source; and a valve mechanism control device which outputs a control command to remotely control opening and closing of the supply valve mechanism and the discharge valve mechanism, and a valve opening setting command to set the opening of a valve of the discharge valve mechanism (namely, to determine ease of fluid discharge). It is needless to say that the above-mentioned low pressure source may include the fluid pressure source depending on circumstances. Specifically, the valve mechanism control device is configured to output a control command to remotely control opening and closing of the supply valve mechanism and the discharge valve mechanism, and a valve opening setting command to set the opening (namely, ease of fluid discharge) for the discharge valve mechanism.

The actuator using a fluid cylinder of the present invention further comprises pressure measurement means for measuring an actual pressure in the chamber.

The supply valve mechanism and the discharge valve mechanism which are provided in the choke valve device may be respectively constituted as a separate structure, or a composite valve mechanism including the supply valve mechanism and the discharge valve mechanism both disposed in one structure may be employed.

In the present invention, the opening of the valve of the discharge valve mechanism is set in accordance with the valve opening setting command. The valve mechanism control device is configured to set the opening of the valve so as to be in inverse proportion to the target pressure of the chamber in which the fluid pressure is adjusted by the choke valve device. Namely, the valve of the supply valve mechanism is opened when the target pressure is higher than the actual pressure. Alternatively, the valve of the discharge valve mechanism may be closed. The valve mechanism control device is also configured to close the valve of the supply valve mechanism and set the opening of the valve of the discharge valve mechanism so as to be in inverse proportion to the magnitude of the target pressure when the target pressure is lower than the actual pressure. When the actual pressure reaches the target pressure, the valve of the discharge valve mechanism is closed.

The valve mechanism control device is also configured to output a valve opening setting command and a control command as described below. The valve mechanism control device outputs a valve opening setting command to set the opening of the valve so as to be in inverse proportion to the target pressure in the chamber in which the fluid pressure is adjusted by the choke valve device. In response to the valve opening setting command, the opening of the valve of the discharge valve mechanism is determined in accordance with the target pressure at first. A control command to open the valve of the supply valve mechanism is outputted when the target pressure is higher than the actual pressure. A control command to close the valve of the discharge valve mechanism is outputted when the actual pressure reaches the target pressure. When the target pressure is lower than the actual pressure, a control command to close the valve of the supply valve mechanism and to open the valve of the discharge valve mechanism is outputted. When the actual pressure reaches the target pressure, a control command to close the valve of the discharge valve mechanism is outputted.

If an incoming or outgoing flow of the fluid to/from the fluid cylinder is stopped, or if a flow path for the fluid connected to the fluid cylinder is narrowed, a passive resistance which acts to resist piston movement is generated by repulsion (spring effect) of the compressed fluid or by the fluid-flow resistance (the damper effect) of the incoming or outgoing fluid. The present invention pays attention to the generation of this passive resistance and utilizes the resistance as rigidity of the fluid cylinder. Namely, the resistance against piston movement is effectively generated by appropriately choking the flow of the fluid in the flow path through which the fluid discharged from the first chamber and the second chamber of the fluid cylinder flows. Rigidity is thereby given to the fluid cylinder using the resistance (the piston is stopped in a specified position and becomes hard to move by an external force).

For example, in order to provide rigidity to the piston at a specified position after moving the piston to a certain moving direction, the following steps are carried out. The first step is to increase the amount of the fluid (fluid pressure) which is supplied from the fluid pressure source of the choke valve device disposed for the chamber of which the internal pressure is required to be raised when moving the piston. The next step is to give the fluid cylinder rigidity by appropriately choking the fluid flow with the choke valve device through which the fluid flows after being discharged from the chamber into which the piston is moving. Choking the fluid flow is accomplished by adjusting the opening of the valve of the discharge valve mechanism disposed for the corresponding choke valve device. In the present invention, the valve opening of the discharge valve mechanism is determined based on the target pressure of the fluid in the intended chamber. Specifically, the valve mechanism control device outputs a valve opening setting command to set the opening of the valve of the discharge valve mechanism so as to be in inverse proportion to the target pressure in the chamber in which the fluid pressure is adjusted by the choke valve device. Namely, the opening of the valve of the discharge valve mechanism is set small when the target pressure is high, and the opening thereof is set large when the target pressure is low. This comes from a presumption that a high target pressure is aimed at attaining high rigidity while a low target pressure is aimed at attaining low rigidity. The smaller the opening of the valve of the discharge valve mechanism is, the more slowly the actual pressure in the chamber decreases, thereby letting the actual pressure reach the target pressure while maintaining the high rigidity. When the opening of the valve of the discharge valve mechanism is set large, the actual pressure in the chamber is lowered quickly, thereby promptly reducing the actual pressure in the chamber down to the target pressure necessary for attaining low rigidity.

Increasing or decreasing the opening of the valve of the discharge valve mechanism is carried out in a relative manner. For example, when there are only two levels, large and small, for the opening of the valve of the discharge valve mechanism to be used, decreasing the opening means selecting the small opening and increasing the opening means selecting the large opening. When there are a plurality of levels for the opening of the valve of the discharge valve mechanism, the target pressure may be divided into the same number of levels as the number of levels for valve opening, and levels of valve opening may be predetermined in a one-for-one relationship between the target pressure and the valve opening. In this manner, selection of the opening of the valve of the discharge valve mechanism will become quite simple.

When the valve opening for the discharge valve mechanism can be selected incrementally or decrementally from a plurality of levels, the discharge valve mechanism may include: two or more kinds of open/close valves that are connected in parallel to each other and respectively have a discharge path of a different cross-sectional area; and valve selection control means for selecting a combination of the open/close valves from among the two or more kinds of open/close valves in accordance with the valve opening setting command so that a summation of the cross-sectional areas of the discharge paths of the selected valves may be the closest to a target cross-sectional area, and opening the selected open/close valves when the control command is inputted. With such discharge valve mechanism, multiple levels of valve opening may be arranged merely by selecting from among the two or more kinds of open/close valves. As the two or more kinds of open/close valves, those valves may be used, each having a discharge path of a cross-sectional area calculated by multiplying the smallest cross-sectional area by the $n^{th}$ power of base number a (where n=0, 1, 2, 3, . . . , and a>1). Namely, the two or more kinds of open/close valves respectively have a discharge path of a different cross-sectional area. The discharge path of one of the open/close valves has the smallest cross-sectional area S among the two or more kinds of open/close valves. The discharge paths of the remaining open/close valves respectively have a cross-sectional area calculated by multiplying the smallest cross-sectional area S by the $n^{th}$ power of base number a larger than one (that is, $a^n$*S where n=1, 2, 3, . . . ). In this manner, the levels for valve opening may be maximized with respect to the number of the number of disposed open/close valves.

When the base number a is a value close to one, increments of the valve opening level will be almost constant over the whole range. The larger the base number a is, the finer increments of the valve opening level will be obtained in a local range, and the rougher increments of the valve opening level will be obtained in other local ranges. The value of the base number may arbitrarily be determined according to how the actuator should be controlled. For example, when the smallest cross-sectional area is very small, the base number should be set close to one. When the smallest cross-sectional area is large enough, the base number may be set to a large value such as 2 and 3. This is because a slight change of the cross-sectional area brings about a substantial change in the fluid resistance in the flow path when the smallest cross-sectional area is very small. When the smallest cross-sectional area is large enough, a change of the cross-sectional area hardly brings about a change in the fluid resistance in the flow path. In this case, it is advisable to arrange valves M each having a greatly different cross-sectional area to efficiently bring about a difference in the fluid resistance in the flow path.

The discharge valve mechanism may include: a valve equipped with an opening adjustment mechanism capable of incrementally or decrementally adjusting the opening of the valve; an open/close valve which is disposed in series with the valve equipped with the opening adjustment mechanism is controlled by the vale equipped with the opening adjustment mechanism for opening and closing; and valve control means for setting the opening of the valve equipped with the opening adjustment mechanism in accordance with the valve opening setting command and for controlling the open/close valve in accordance with the control command.

More specifically, the valve-mechanism control device may be configured to output the valve opening setting command to set the opening of the valve of the discharge valve mechanism in the following manner. First, a reference pressure is identified with respect to the target pressure and a reference opening is identified with respect to the opening of the valve of the discharge valve mechanism. When the target pressure is higher than the actual pressure, the opening of the valve of the discharge valve mechanism is set to zero. When the target pressure is lower than the actual pressure and higher than the reference pressure, the opening of the valve of the discharge valve mechanism is set to be smaller than the reference opening. When the target pressure is lower than both of the actual pressure and the reference pressure, the opening of the valve of the discharge valve mechanism is set to be larger than the reference opening. Further, when the target pressure is zero, the opening of the valve of the discharge valve mechanism is maximized. In this manner, the actuator may practically be controlled even when there are few predetermined levels for valve opening.

For assured controlling, the valve mechanism control device may preferably be configured to output the valve opening setting command to the discharge valve mechanism before outputting the control command to instruct the discharge valve mechanism to open/close the valve.

In a control method of the actuator according to the present invention, the target pressure is compared with the actual pressure in the chamber in which fluid is supplied through the supply valve mechanism. Wherever the target pressure is higher than, or equal to, or lower than the actual pressure, the opening of the valve of the discharge valve mechanism is set so as to be in inverse proportion to the target pressure of the chamber in which the fluid pressure is adjusted. When the target pressure is higher than the actual pressure, a control command to open the valve is outputted to the supply valve mechanism after the opening of the valve of the discharge valve mechanism has been set to zero. When the target pressure is lower than the actual pressure and higher than the reference pressure, a control command to open the valve is outputted to the discharge valve mechanism, after the opening of the valve of the discharge valve mechanism has been set to be smaller than the reference opening. When the target pressure is lower than both of the actual pressure and the reference pressure, a control command to open the valve is outputted to the discharge valve mechanism, and a control command to close the valve is outputted to the supply valve mechanism, after the opening of the valve of the discharge valve mechanism has been set to be larger than the reference opening. Further, when the target pressure is zero, the control command to open the valve is outputted to the discharge valve mechanism and the control command to close the valve is outputted to the supply valve mechanism, after a valve opening setting command to maximize the opening of the valve of the discharge valve mechanism has been outputted. Then, when the actual pressure reaches the target pressure, the control command to close the valves of the supply valve mechanism and the discharge valve mechanism is outputted. In this manner, desired high or low rigidity may reliably be provided to the fluid cylinder with a simple configuration.

BRIEF DESCRIPTION OF THE DRAWINGS

FIG. 7 is a flowchart showing an algorithm for another method of controlling the actuator using a fluid cylinder of FIG. 4.

BEST MODE FOR CARRYING OUT THE INVENTION

Figure 1:
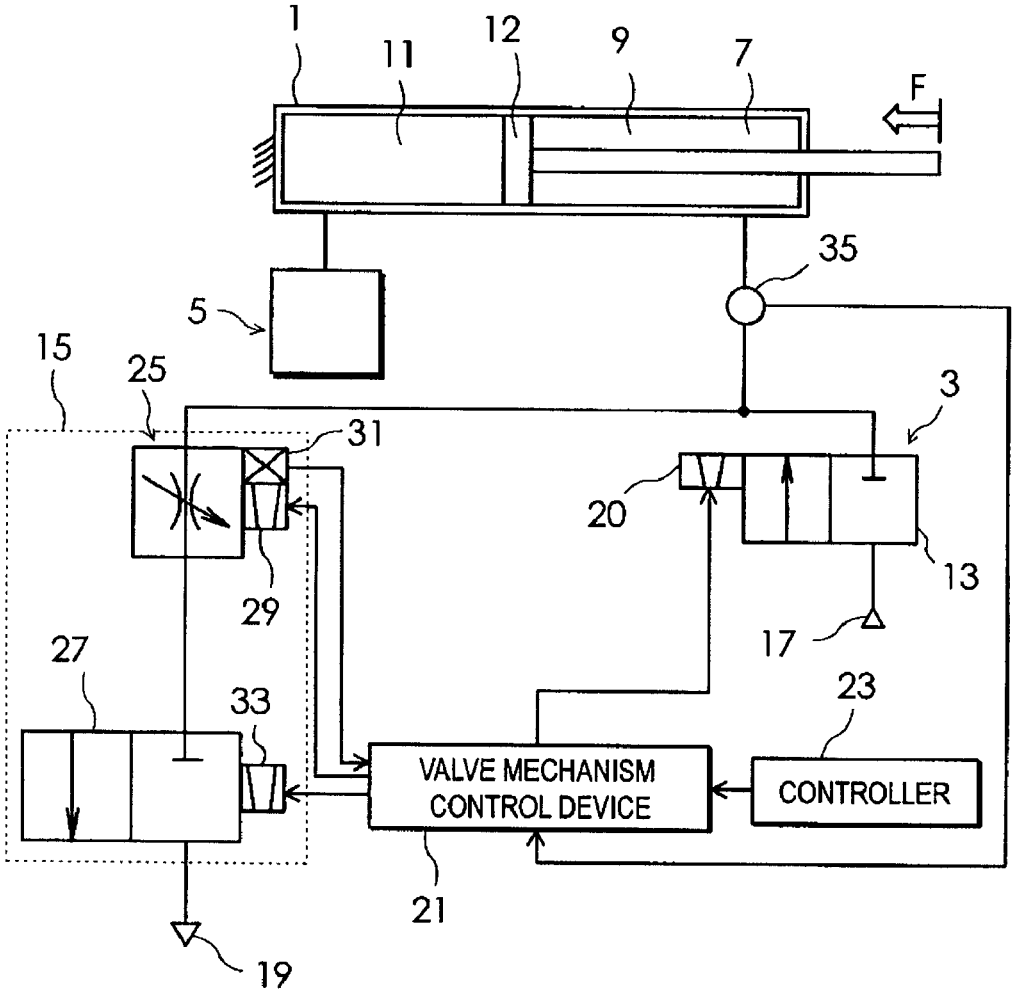
FIG. 1 is a conceptual diagram of an actuator using a fluid cylinder according to a first embodiment of the present invention.

Hereafter, embodiments of the present invention are described with reference to the drawings. FIG. 1 is a conceptual diagram conceptually showing a configuration of an actuator using a fluid cylinder according to a first embodiment of the present invention. The actuator using a fluid cylinder according to the first embodiment includes a fluid cylinder 1, a first choke valve device 3, and a second choke valve device 5. The fluid cylinder 1 includes a cylinder chamber 7 and a piston 12 slidably disposed in the cylinder chamber 7 so as to partition the cylinder chamber 7 into a first chamber 9 and a second chamber 11. In this embodiment, an air cylinder is used as the fluid cylinder 1 for the purpose of explanation. Of course, an oil cylinder which is driven by a fluid pressure may be used as the fluid cylinder 1.

The first choke valve device 3 is disposed between a fluid pressure source, not shown, and the first chamber 9 to adjust a flow of the fluid flowing into the first chamber 9. The fluid pressure source is configured to receive the fluid flowing out of the first chamber 9 when a pressure in the first chamber 9 becomes larger than the pressure of the fluid supplied from the fluid pressure source. As well, the second choke valve device 5 is disposed between the fluid pressure source, not shown, and the second chamber 11 to adjust the flow of the fluid flowing into the second chamber 11. The second choke valve device 5 is shown as a simple block diagram in which detailed description is omitted since the second choke valve device has the same configuration and functionality as the first choke valve device 3. Hereinafter, the configuration of the first choke valve device 3 is explained and explanation about the second choke valve device 5 is omitted.

In the embodiment of the present invention, the first and second choke valve devices 3 and 5 respectively have a separate fluid pressure sources. However, one common fluid pressure source may be provided for the first and second choke valve devices 3 and 5.

As shown in FIG. 1, the first choke valve device 3 includes a supply valve mechanism 13 which allows the fluid to flow in an incoming direction from the fluid pressure source, not shown, to the corresponding first chamber 9 and a discharge valve mechanism 15 which allows the fluid to flow in an outgoing direction from the first chamber 9 to the atmosphere or a low pressure source. The supply valve mechanism 13 and the discharge valve mechanism 15 have a supply port 17 for the incoming fluid and a discharge port 19 for the outgoing fluid respectively. Valves of the supply valve mechanism 13 and the discharge valve mechanism 15 are opened and closed in accordance with a command from a valve mechanism control device 21. Control conditions such as target pressure are inputted into the valve mechanism control device 21 from a higher-level controller 23.

The valve mechanism control device 21 also outputs to the discharge valve mechanism 15 a valve opening setting command that sets an opening of the valve. The supply valve mechanism 13 opens and closes valves with an actuator 20 activated in accordance with a control command from the valve mechanism control device 21. The discharge valve mechanism 15 includes: a valve 25 equipped with an opening adjustment mechanism capable of incrementally or decrementally adjusting the opening of the valve; an open/close valve 27 which is disposed in series with the valve 25 equipped with the opening adjustment mechanism and is controlled for opening and closing; a continuously variable actuator 29 for setting the opening of the valve 25 equipped with the opening adjustment mechanism in accordance with the valve opening setting command; valve position detection means 31 for detecting a position of the valve; and an actuator 33 which controls opening and closing of the open/close valve 27. The continuously variable actuator 29, the valve position detection means 31, and the actuator 33 constitute valve control means. In order to make variable the opening of the valve 25 equipped with the opening adjustment mechanism, the valve mechanism control device 21 carries out a feedback control for the continuously variable actuator 29 based on an output from the valve position detection means 31. A member designated at a reference numeral 35 is pressure measurement means for measuring an actual pressure in the first chamber 9.

As will be explained later, a flow path of the fluid connected to the fluid cylinder 1 is narrowed or expanded (decreasing or increasing the opening) by setting the opening of the valve 25 equipped with the opening adjustment mechanism of the discharge valve mechanism 15 so as to be in inverse proportion to the target pressure indicated by the controller 23. As a result, repulsion (spring effect) of the compressed fluid and fluid-flow resistance (the damper effect) of the incoming/outgoing fluids are generated to produce a passive resistance which acts to hamper the movement of the piston 12. The embodiment of the present invention utilizes the resistance as the rigidity of the fluid cylinder. Namely, the resistance hampering the movement of the piston is effectively generated in the flow path through which the fluid discharged from the first chamber 9 and the second chamber 11 in the fluid cylinder 1 flows, by appropriately choking the flow of the discharged fluid. The resistance may provide the fluid cylinder 1 with high rigidity (a state in which the piston 12 is stopped in a specified position and becomes hard to move by an external force), and low rigidity (a state in which the piston 12 is stopped in a specified position but can be moved even by a weak external force).

For example, the second choke valve device 5 is activated to move the piston 12 from the second choke valve device 11 to the first chamber 9. Then, in order to provide the rigidity to the fluid cylinder when the piston 12 is stopped in a specified position, the controller 23 indicates the target pressure $P_D$ of the first chamber 9 to the valve mechanism control device 21. Next, the amount of supply of the fluid (fluid pressure) flown out of the fluid pressure source disposed for the second choke valve device 5 is increased to raise an internal pressure of the second chamber 11. The opening of the valve 25 of the discharge valve mechanism 15 for the first choke valve device 3, through which the fluid flows out of the first chamber 9 into which the piston 12 is moved, is set so as to be in inverse proportion to the target pressure $P_D$. This setting is carried out by outputting a valve opening setting command to the continuously variable actuator 29 from the valve mechanism control device 21. In the present embodiment, the valve opening setting command is inputted into the continuously variable actuator 29 from the valve mechanism control device 21 before the control command to open the valve is outputted from the valve mechanism control device 21 to the actuator 33 that controls opening and closing of the valve of the open/close valve 27. Therefore, when the control command to open the open/close valve 27 is inputted into the actuator 33 to open the open/close valve 27, the opening of the valve 25 equipped with the opening adjustment mechanism has already been set so as to be in inverse proportion to the target pressure $P_D$.

By referring to a flowchart in FIG. 2, how to determine the valve opening of the discharge valve mechanism 15 based on the target pressure $P_D$ in the first chamber 9 will specifically be described below. The valve mechanism control device 21 outputs the valve opening setting command which sets the opening of the valve of the discharge valve mechanism 15 so as to be in inverse proportion to the target pressure $P_D$ of the chamber 9, to which fluid is supplied through the supply valve mechanism 13. Namely, the opening of the valve 25 of the discharge valve mechanism 15 is determined so that the opening of the valve 25 of the discharge valve mechanism 15 may be set small when the target pressure $P_D$ is high, and the opening of the valve mechanism 15 may be set large when the target pressure $P_D$ is low. The opening of the valve of the discharge valve mechanism 15 is set small or large in a relative manner. So, when there are two levels, small and large, to select for the opening of the valve of the discharge valve mechanism 15 to be used, setting the opening small means selecting the small opening level, and setting the opening large means selecting the large opening level.

As with the present embodiment, although the discharge valve mechanism 15 includes the valve 25 equipped with an opening adjustment mechanism capable of incrementally or decrementally adjusting the opening of the valve, and the open/close valve 27 which is disposed in series with the valve 25 equipped with an opening adjustment mechanism and is controlled by the valve 25 equipped with an opening adjustment mechanism for opening and closing, the opening of the valve may be set in two levels. For example, when a small opening is required, the opening of the valve 25 equipped with the opening adjustment mechanism may be minimized. When a large opening is required, the opening of the valve 25 equipped with the opening adjustment mechanism may be maximized. Alternatively, the opening of the valve 25 equipped with the opening adjustment mechanism may be set according to the relationship in magnitude of the pressure between the target pressure $P_D$ and reference pressure $P_r$.

Figure 2:
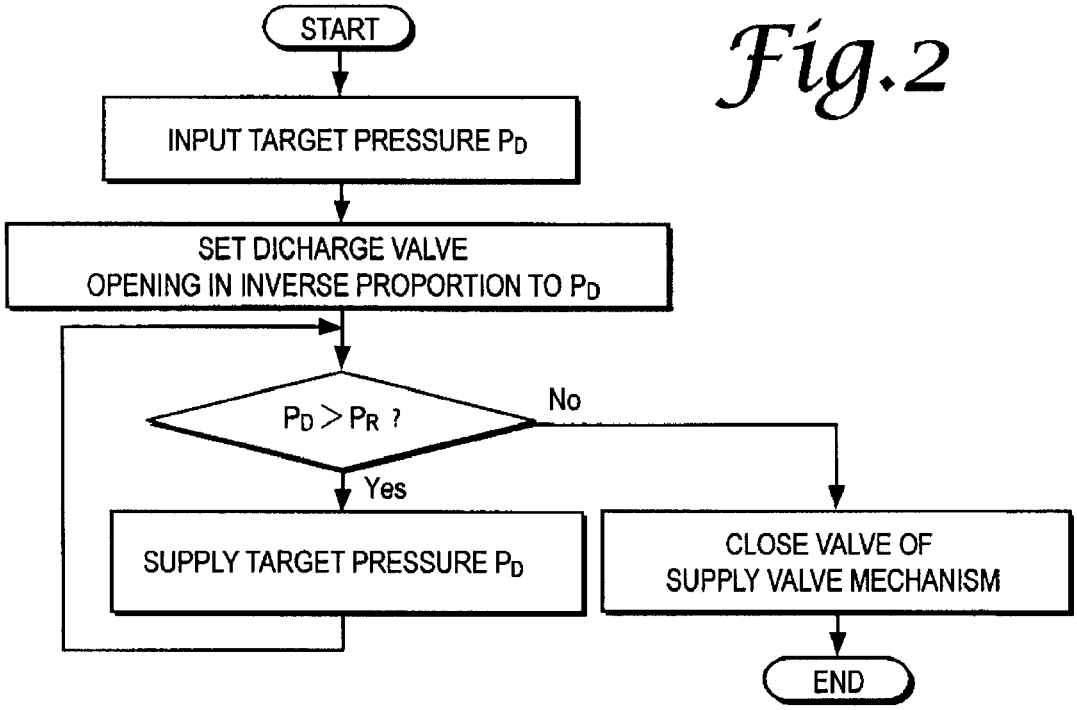
FIG. 2 is a flowchart showing an algorithm for a method of controlling the actuator using a fluid cylinder of FIG. 1.

FIG. 2 is a flowchart showing an example of algorithm for a method of controlling the actuator shown in FIG. 1. In this example, the target pressure $P_D$ is first inputted into the valve mechanism control device 21 from the controller 23. The valve mechanism control device 21 determines the opening of the valve 25 for the discharge valve mechanism 15 so as to be in inverse proportion to the magnitude of the target pressure $P_D$. Namely, an inverse proportional relationship means that the opening of the valve 25 of the discharge valve mechanism 15 is set small when the target pressure $P_D$ is high and that the opening of the valve 25 of the discharge valve mechanism 15 is set large when the target pressure $P_D$ is low. Then actual pressure $P_R$ in the chamber 9 is measured with the pressure measurement means 35. When the target pressure $P_D$ is higher than the actual pressure $P_R$, the control command to open the valve of the supply valve mechanism 13 is outputted to the actuator 20 from the valve mechanism control device 21. Since the opening of the valve 25 equipped with an opening adjustment mechanism is set in advance according to the magnitude of the target pressure $P_D$, the fluid is discharged from the chamber 9 through the discharge valve mechanism 15 with a valve-choke condition determined by the opening set in advance. If the actual pressure $P_R$ in the chamber 9 reaches the target pressure $P_D$, the control command to close the valve of the supply valve mechanism 13 is outputted from the valve mechanism control device 21 to the actuator 20. At that time, the control command to close the valve of the open/close valve 27 may be outputted to the discharge valve mechanism 15 from the valve mechanism control device 21. In the present embodiment of the control method, however, assuming that the target pressure $P_D$ is continuously changed, the valve of the open/close valve 27 is not closed. In this manner, the actual pressure in the chamber 9 immediately reaches the target pressure $P_D$, and is capable of acquiring high or low rigidity with certainty.

In the above-mentioned control method, the same control is also carried out in the second choke valve device 5 with respect to the second chamber 11. The controller 23 may be arranged separately for each of the first choke valve device 3 and the second choke valve device 5.

Figure 3:
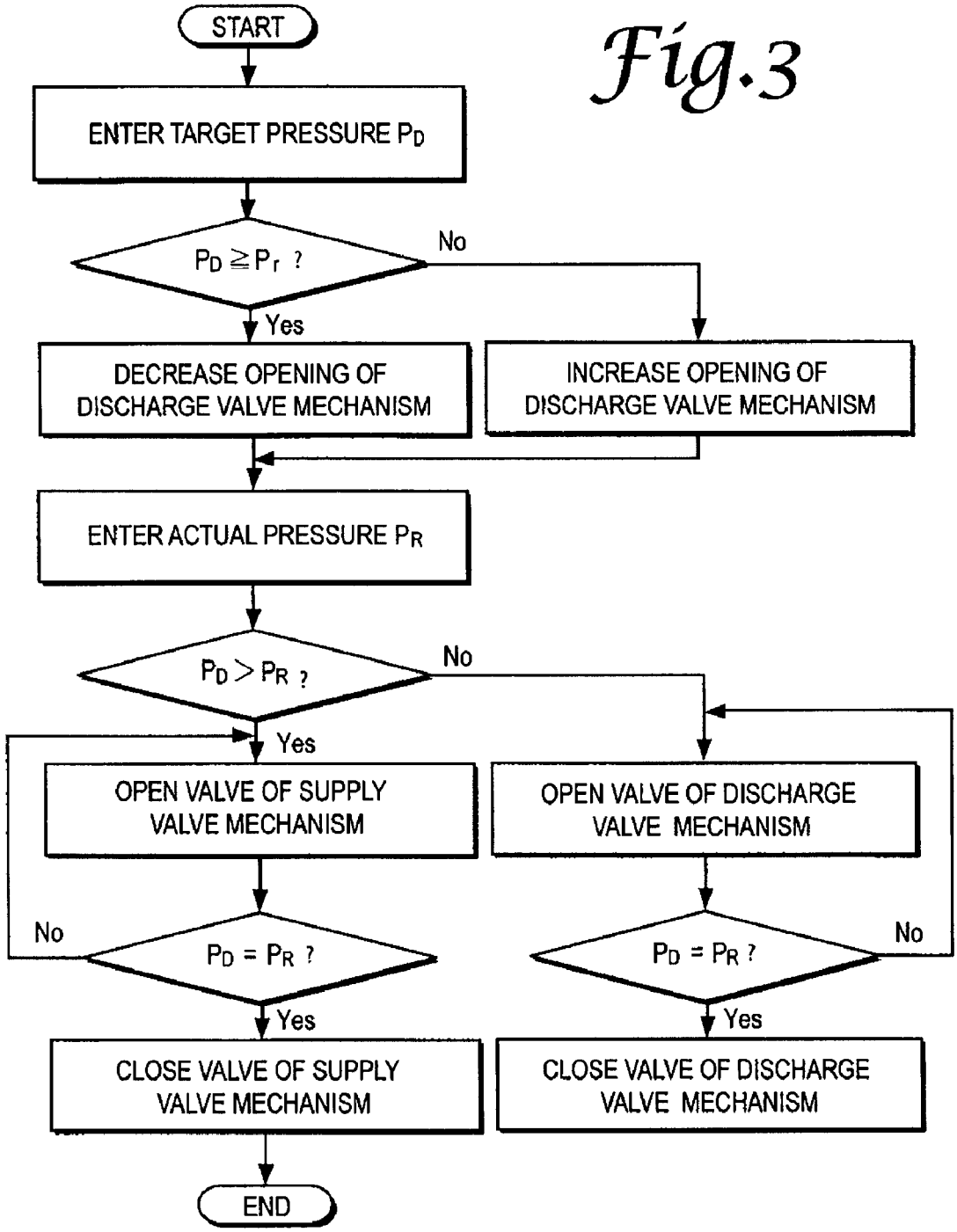
FIG. 3 is a flowchart showing an algorithm for another method of controlling the actuator using a fluid cylinder of FIG. 1.

FIG. 3 is a flowchart showing an algorithm for another method of controlling the actuator shown in FIG. 1. In this example, the target pressure $P_D$ is first inputted into the valve mechanism control device 21 from the controller 23. The valve mechanism control device 21 compares the magnitude of the target pressure $P_D$ with that of the reference pressure $P_r$. When the target pressure $P_D$ is larger than the reference pressure $P_r$, the opening of the valve 25 of the discharge valve mechanism 15 is set small. When the target pressure $P_D$ is smaller than the reference pressure $P_r$, the opening of the valve 25 of the discharge valve mechanism 15 is set large by the valve mechanism control device 21. How to determine the reference pressure $P_r$ is arbitrary. For example, the mean value in an available range of the target pressure $P_D$ may be taken as the reference pressure $P_r$, so that the opening may be determined on the basis of whether or not the target pressure $P_D$ is higher than the reference pressure $P_r$. When the target pressure $P_D$ is higher than the reference pressure $P_r$, the opening of the valve of the discharge valve mechanism 15 may be set small so as to be in inverse proportion to the target pressure $P_D$. In this example, the opening may be set in two levels, small and high, in a pre-definable range in order to simplify the control. The actual pressure $P_R$ in the chamber 9 is measured with the pressure measurement means 35. When the target pressure $P_D$ is higher than the actual pressure $P_R$, the control command to open the valve of the supply valve mechanism 13 is outputted to the actuator 20 from the valve mechanism control device 21. At this time, the control command to close the valve of the discharge valve mechanism 15 is also outputted and the valve of the discharge valve mechanism 15 is closed. When the actual pressure $P_R$ in the chamber 9 reaches the target pressure $P_D$ after the actuator 20 opens the valve of the supply valve mechanism 13, the valve mechanism control device 21 outputs the control command to close the valve of the supply valve mechanism 13 to the actuator 20. Up to this point, the discharge valve mechanism 15 is not opened.

When the target pressure $P_D$ is lower than the actual pressure $P_R$, the control command to open the open/close valve 27 of the discharge valve mechanism 15 is outputted from the valve mechanism control device 21 to actuator 33 to open the open/close valve 27. At this time, the control command to close the valve of the supply valve mechanism 13 is outputted to the actuator 20 from the valve mechanism control device 21, and the valve of the supply valve mechanism 13 is closed. Since the opening of the valve 25 equipped with an opening adjustment mechanism is set in advance in accordance with the magnitude of the target pressure $P_D$, the fluid is discharged from the chamber 9 through the discharge valve mechanism 15 with a valve-choke condition determined by the opening set in advance.

Namely, when the target pressure $P_D$ is higher than the reference pressure $P_r$ (when high rigidity is required), the pre-determined, required small opening is set in advance as the opening of the valve 25 equipped with the opening adjustment mechanism. When the target pressure $P_D$ is lower than the reference pressure $P_r$ (when low rigidity is required), the pre-determined large opening is set in advance as the opening of the valve 25 equipped with the opening adjustment mechanism. When the actual pressure $P_R$ in the chamber 9 reaches the target pressure $P_D$, the control command to close the valve of the open/close valve 27 is outputted to the actuator 33 by the valve mechanism control device 21. In this manner, the actual pressure in the chamber 9 immediately reaches the target pressure $P_D$ and high or low rigidity may be attained with certainty.

Incidentally, if the opening of the valve 25 equipped with the opening adjustment mechanism is set further more finely in accordance with the magnitude of the target pressure $P_D$, more precise rigidity may be provided to the cylinder 1.

In the above-mentioned control, a similar control is also performed in the second choke valve device 5 with respect to the second chamber 11. The controller 23 may be arranged separately for each of the first choke valve device 3 and the second choke valve device 5.

Figure 4:
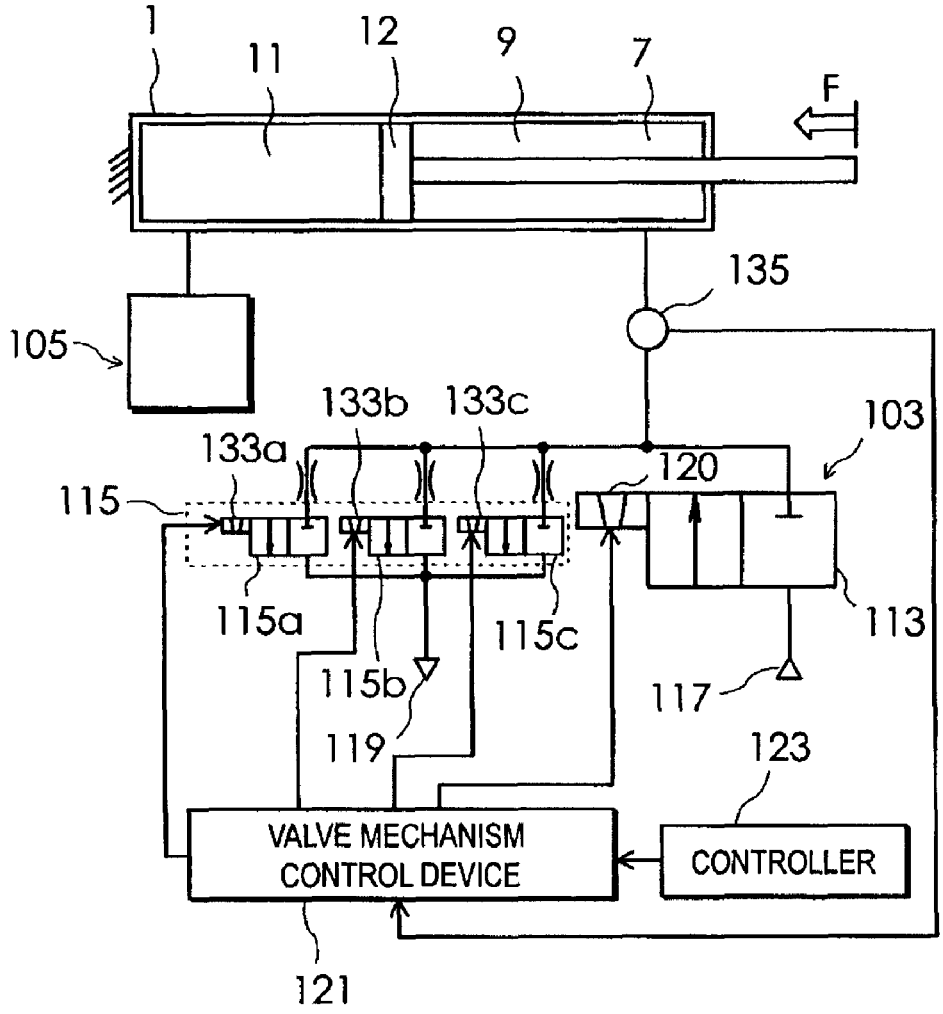
FIG. 4 is a conceptual diagram of an actuator using a fluid cylinder according to a second embodiment of the present invention.

FIG. 4 is a conceptual diagram of an actuator using a fluid cylinder according to a second embodiment of the present invention. In FIG. 4, parts of the configuration similar to corresponding parts of the configuration of the embodiment shown in FIG. 1 have reference numerals calculated by adding a number 100 to the corresponding reference numerals of the embodiment of FIG. 1, and the detailed description will be omitted. In the present embodiment, the discharge valve mechanism 115 to be used is the one which is configured to be able to select the opening of the valve of the discharge valve mechanism from among two or more levels. The discharge valve mechanism 115 to be used, which is configured to be able to select the opening from among the two or more levels, includes three kinds of open/close valves 115*a* to 115*c* that are connected in parallel to each other, each having a discharge path of a different cross-sectional area; actuators 133*a* to 133*c* that control opening and closing of the three kinds of open/close valves 115*a* to 115*c*; and valve selection control means for selecting at least one or more open/close valves from the three kinds of open/close valves 115*a* to 115*c* in accordance with a valve opening setting command at the time of discharging, and for opening the selected open/close valves when the control command is inputted. The valve selection control means is constituted by the actuators 133*a* to 133*c* and a valve mechanism control device 121.

With such discharge valve mechanism 115, various levels of openings may be set by selecting from among the two or more kinds of open/close valves. Among the two or more kinds of open/close valves each having a discharge path of a different cross-sectional area, one of the valves has a discharge path of the smallest cross-sectional area S of the two or more kinds of open/close valves. The discharge paths of the remaining open/close valves respectively have a cross-sectional area calculated by multiplying the smallest cross-sectional area by the $n^{th}$ power of the base number a larger than one (that is, $a^n$*S where n=1, 2, 3, . . . ). Incidentally, when n is zero, the cross-sectional area is the smallest. In this manner, the maximal opening levels may be defined for the number of the disposed open/close valves.

Figure 5A:
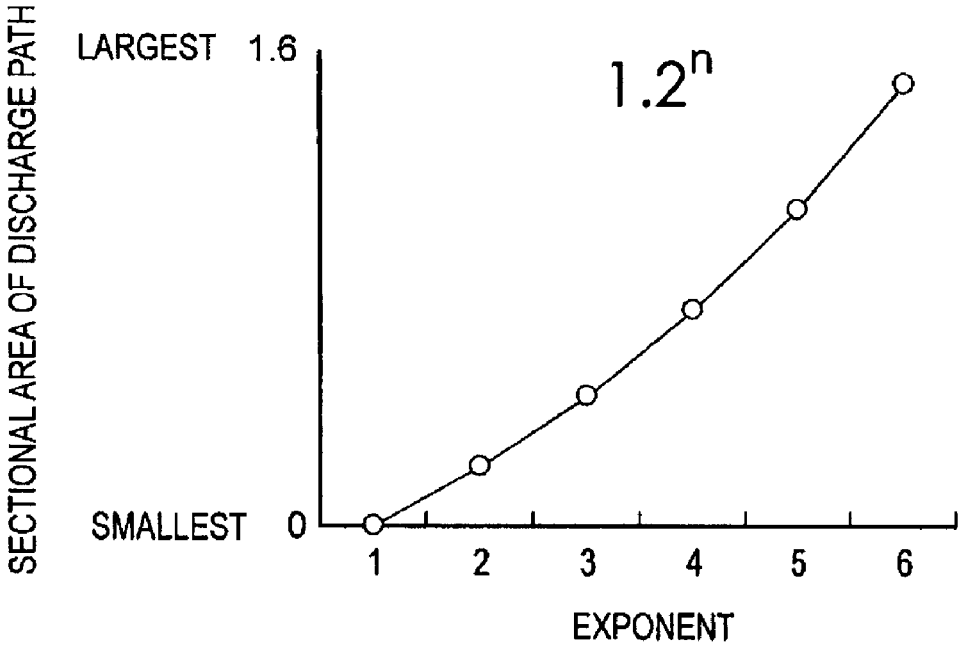
FIGS. 5A to 5C are charts showing relationships between exponents and cross-sectional areas of discharge paths, which are used in order to explain the concept of discharge valve opening when disposing two or more kinds of open/close valves each having a cross-sectional area calculated by multiplying the smallest cross-sectional area of the discharge path by a power of a base number larger than one.
Figure 5B:
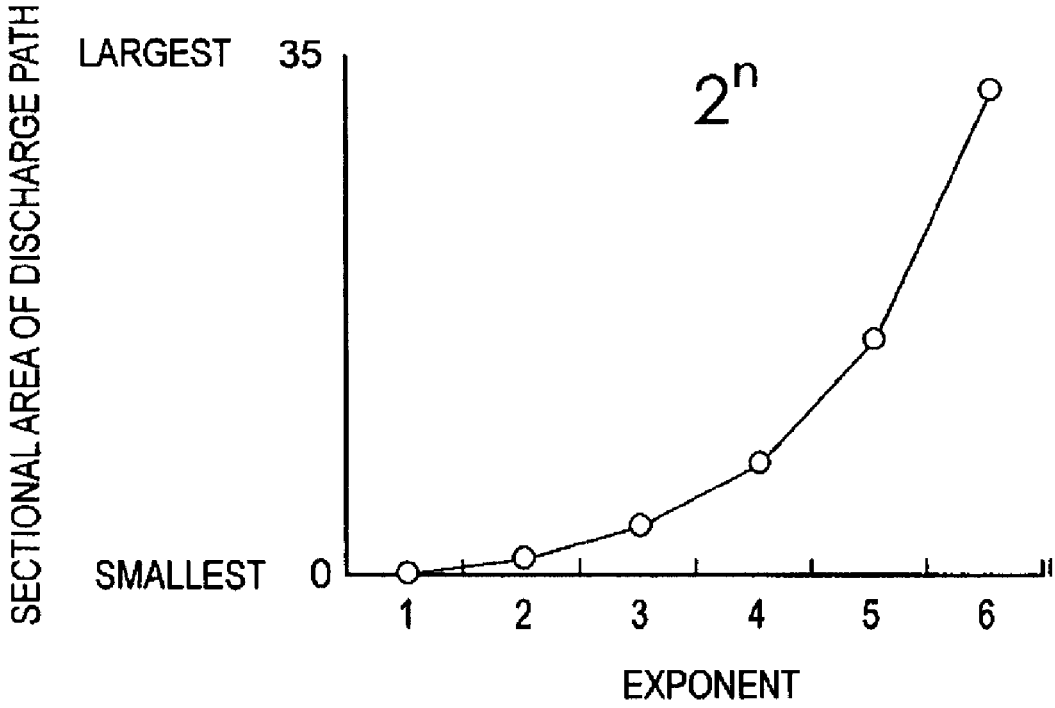
Figure 5C:
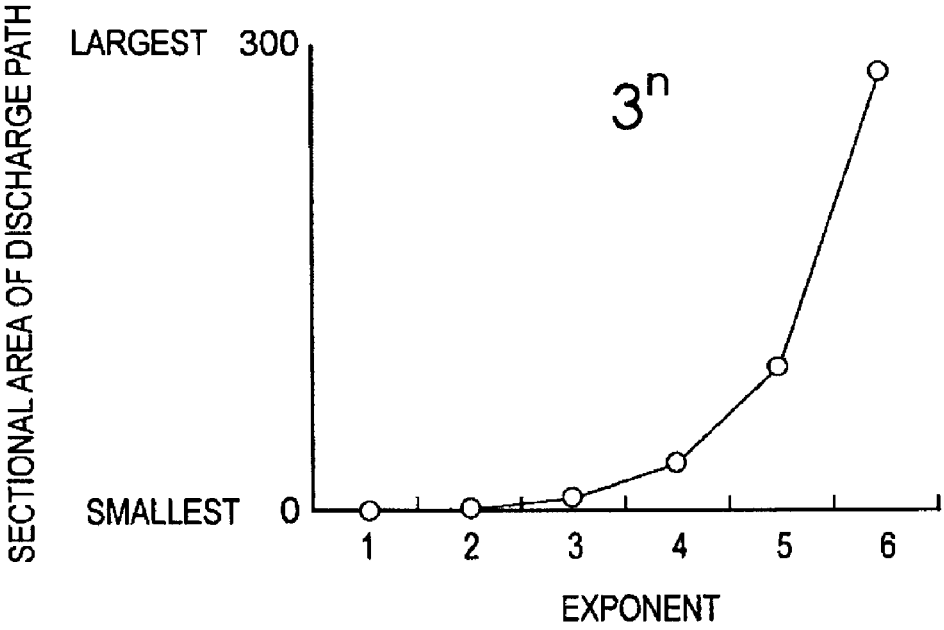

FIGS. 5A to 5C are conceptual charts showing a change in cross-sectional area of the discharge path, i.e., a change of the opening, in accordance with the value of the base number a, when there are two or more kinds of the open/close valves with the cross-sectional area calculated by multiplying the cross-sectional area of the smallest discharge path by the $n^{th}$ power of the base number a larger than one ($a^n$). In FIGS. 5A to 5C, the abscissa or the horizontal axis shows the exponents (n), and the ordinate or the vertical axis shows the relative cross-sectional areas (namely, discharge opening). When the base number a is a value close to one, increments of the valve opening level will be almost constant over the whole range. The larger the base number a is, the finer increments of the valve opening level will be obtained in a local range. The size of the base number is defined suitably depending upon how the actuator is controlled. For example, when the smallest sectional area is very small, the value of the base number close to one is chosen for the base number because even a slight change of the cross-sectional area may bring about a substantial change in the fluid resistance in the flow path. When the smallest sectional area is large enough, a larger base number like 2 or 3 is chosen in order to efficiently induce a difference in the fluid resistance in the flow path.

Figure 6:
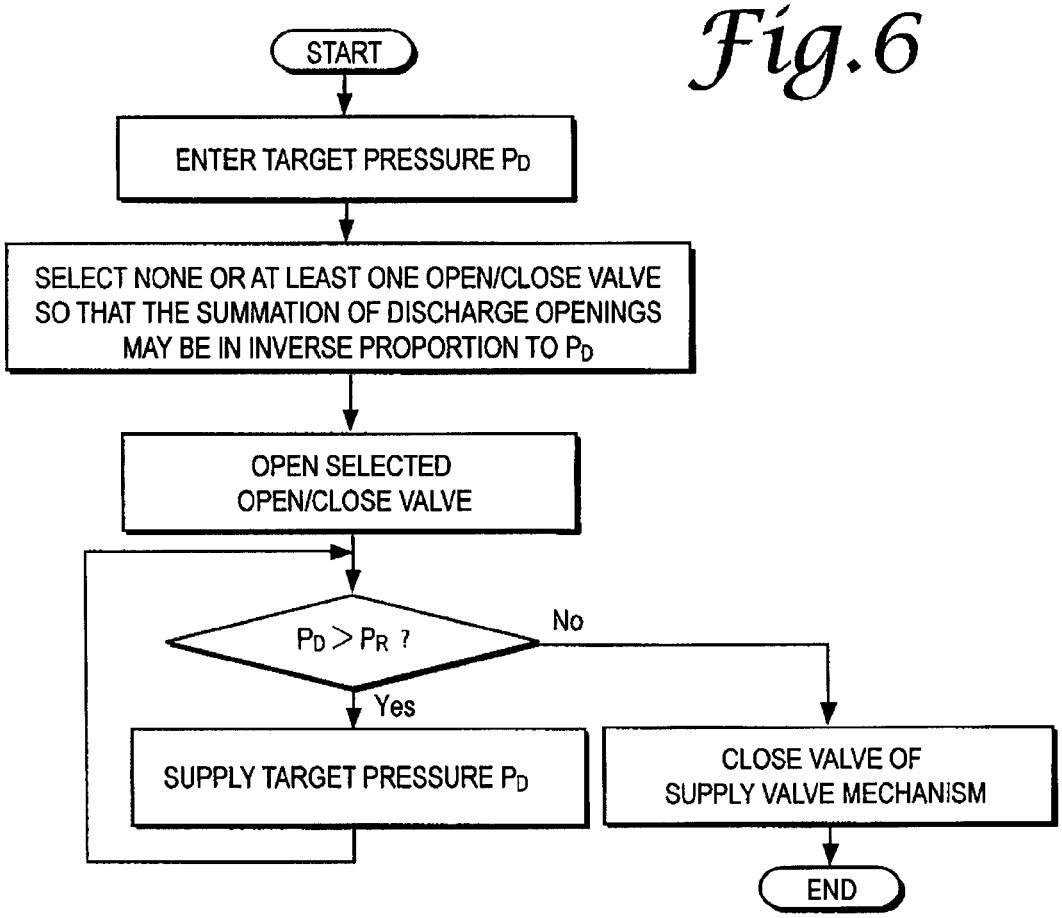
FIG. 6 is a flowchart showing an algorithm for a method of controlling the actuator using a fluid cylinder of FIG. 4.

FIG. 6 is a flowchart showing an algorithm for a method of controlling the actuator of FIG. 4. In this example, the target pressure $P_D$ is first inputted into the valve mechanism control device 121 from a controller 123. The valve mechanism control device 121 calculates a summation of discharge openings so that the summation may have an inverse proportional relationship with the magnitude of the target pressure $P_D$, thereby selecting and determining the open/close vales to be opened in the discharge valve mechanism 115, from among the open/close valves 115*a* to 115*c*. If the target pressure $P_D$ is large, none or zero, or one or more open/close valves of which the cross-sectional areas are comparatively small are opened in the discharge valve mechanism 115. Namely, in some cases, all the open/close valves 115*a* to 115*c* are closed. If the target pressure $P_D$ is small, one or more kinds of the open/close valves each having a comparatively large cross-sectional area are opened in the discharge valve mechanism 115. The actual pressure $P_R$ in the chamber 9 is measured with pressure measurement means 135, and when the target pressure $P_D$ is larger than the actual pressure $P_R$, a control command to open a valve of a supply valve mechanism 113 is outputted to an actuator 120 from the valve mechanism control device 121. Since the summation of the discharge opening of the discharge valve mechanism 115 is set in accordance with the magnitude of the target pressure $P_D$, the fluid is discharged through the discharge valve mechanism 115 from the chamber 9 with the valve-choke condition determined by the opening set in advance. When the actual pressure $P_R$ in the chamber 9 reaches the target pressure $P_D$, the valve mechanism control device 121 outputs a control command to close the valve of the supply valve mechanism 113 to the actuator 120. At that time, the valve mechanism control device 121 may also output a control command to close the open/close valves 115*a* to 115*c* to the discharge valve mechanism 115. However, in the present control method, the control command to close the open/close valves 115*a* to 115*c* is not outputted as with the control method shown in FIG. 2. In this manner, the actual pressure in the chamber 9 may immediately reach the target pressure $P_D$ and high or low rigidity may be attained with certainty.

In the above-mentioned control method, the control is also performed similarly in the second choke valve device 105 with respect to the second chamber 11. The controller 123 may be arranged separately for each of a first choke valve device 103 and a second choke valve device 105.

FIG. 7 is a flowchart showing an algorithm for another method of controlling the actuator using a fluid cylinder of FIG. 4. In this example, half a value of the available target pressure $P_D$ is defined as a reference pressure $P_r$. The algorithm of FIG. 7 is different from the algorithm of FIG. 3, in that the opening of the valve can be selected from among two or more opening levels. The other parts are substantially the same as in the algorithm of FIG. 3. The substantial opening of the discharge valve mechanism 115 is a summation of the openings for the valves selected for opening. The summation of the openings is hereinafter referred to as the total opening. In this algorithm, when the target pressure $P_D$ is higher than the actual pressure, the total opening of the discharge valve mechanism is set small. Here, setting the small opening includes setting the opening to zero. When the target pressure $P_D$ is lower than the actual pressure $P_R$, the total opening of the valve of the discharge valve mechanism 115 is set so as to be in inverse proportion to the target pressure $P_D$. For example, when the openings of the open/close valves 115*a*, 115*b*, and 115*c* are proportionally defined as 1, 2, and 4 respectively, the total opening of the discharge valve mechanism may be selected from among seven kinds of openings, namely, 1, 2, 3, 4, 5, 6, or 7, by opening one or more of the valves. For example, when the total opening is 2, the open/close valve 115*b* is opened. For example, when the total opening is 5, the open/close valves 115*a* and 115*c* are opened. Further, when the target pressure $P_D$ is zero, the opening of the valve of the discharge valve mechanism 115 is maximized. Namely, all of the open/close valves 115*a* to 115*c* are selected for opening. In this manner, actuators may be controlled practically even when the predetermined number of the open/close valves (opening levels) is small. Incidentally, when the number of the open/close is increased, it is possible to finely set the opening of the valve of the discharge valve mechanism 115 in inverse proportion to the target pressure $P_D$.

According to each of the above-mentioned embodiments, desired rigidity may easily be given to the fluid cylinder by setting the opening of the valve of the discharge valve mechanism for the choke valve device so as to be in inverse proportion to the target pressure $P_D$. Accordingly, the actuator of the present embodiment may practically be used as an actuator for driving a control machinery for a robot and the like.

INDUSTRIAL APPLICABILITY

According to the present invention, desired high or low rigidity may reliably be given to a fluid cylinder with a simple configuration.

The invention claimed is:

1. An actuator using a fluid cylinder including two chambers and discharge valve mechanisms for the chambers, wherein the opening of a valve of the discharge valve mechanism is set to be in inverse proportion to a target pressure in the chamber, the discharge valve mechanism includes two or more kinds of open/close valves that are connected in parallel to each other and respectively have a discharge path of a different cross-sectional area, the discharge valve mechanism is configured to select one or more of the open/close valves and to optimally adjust a summation of discharge openings of the selected one or more valves in accordance with the target pressure, and the discharge path of one of the two or more kinds of open/close valves has the smallest cross-sectional area among the open/close valves, and the discharge paths of the remaining open/close valves respectively have a cross-sectional area calculated by multiplying the smallest cross-sectional area by a power of a base number larger than one.

2. The actuator using a fluid cylinder according to claim 1, wherein the base number larger than one is two.

3. An actuator using a fluid cylinder including two chambers and discharge valve mechanism for the chambers, wherein the opening of a valve of the discharge valve mechanism is set to be in inverse proportion to a target pressure in the chamber, the discharge valve mechanism includes two or more kinds of open/close valves that are connected in parallel to each other and respectively have a discharge path of a different cross-sectional area, and the discharge path of one of the open/close valves has the smallest cross-sectional area among the open/close valves, and the discharge paths of the remaining open/close valves respectively have a cross-sectional area calculated by multiplying the smallest cross-sectional area by a power of a base number larger than one.

4. The actuator using a fluid cylinder according to claim 3, wherein the base number larger than one is two.

5. An actuator using a fluid cylinder which includes two chambers and discharge valve mechanisms for the chambers comprising a first choke valve device and a second choke valve device, wherein the fluid cylinder includes a cylinder chamber and a piston slidably disposed in the cylinder chamber so as to partition the cylinder chamber into a first chamber and a second chamber as the two chambers, the first choke valve device is disposed between a fluid pressure source and the first chamber to adjust a fluid pressure in the first chamber, the second choke valve device is disposed between the fluid pressure source and the second chamber to adjust a fluid pressure in the second chamber, the first and the second choke valve devices respectively include:

a remotely-controllable supply valve mechanism which allows a fluid to flow in an incoming direction from the fluid pressure source to the corresponding chamber, a remotely-controllable discharge valve mechanism which allows the fluid to flow in an outgoing direction from the chamber to the atmosphere or a low pressure source, and a valve mechanism control device which controls opening and closing of the supply valve mechanism and the discharge valve mechanism, and sets the opening of the valve of the remotely-controllable discharge valve mechanism, the remotely-controllable discharge valve mechanism is the discharge valve mechanism, the valve mechanism control device is configured to set the opening of the valve of the discharge valve mechanism so as to be in inverse proportion to the target pressure in the chamber in which the fluid pressure is adjusted by the choke valve device, the discharge valve mechanism includes two or more kinds of open/close valves that are connected in parallel to each other and respectively have a discharge path of a different cross-sectional area, the discharge path of one of the open/close valves has the smallest cross-sectional area among the open/close valves, and the discharge paths of the remaining open/close valves respectively have a cross-sectional area calculated by multiplying the smallest cross-sectional area by a power of a base number larger than one.

6. An actuator using a fluid cylinder which includes two chambers and discharge valve mechanisms for the chambers comprising a first choke valve device, a second choke valve device, and pressure measurement means for measuring an actual pressure in the chamber, wherein the fluid cylinder includes a cylinder chamber and a piston slidably disposed in the cylinder chamber so as to partition the cylinder chamber into a first chamber and a second chamber as the two chambers, the first choke valve device is disposed between a fluid pressure source and the first chamber to adjust a fluid pressure in the first chamber, the second choke valve device is disposed between the fluid pressure source and the second chamber to adjust a fluid pressure in the second chamber, the first and the second choke valve devices respectively include:

a remotely-controllable supply valve mechanism which allows a fluid to flow in an incoming direction from the fluid pressure source to the corresponding chamber, a remotely-controllable discharge valve mechanism which allows the fluid to flow in an outgoing direction from the chamber to the atmosphere or a low pressure source, and a valve mechanism control device which controls opening and closing of the supply valve mechanism and the discharge valve mechanism, and sets the opening of the valve of the remotely-controllable discharge valve mechanism, the remotely-controllable discharge valve mechanism is the discharge valve mechanism, the valve mechanism control device is configured to output a control command to control opening and closing of the supply valve mechanism and the discharge valve mechanism, and to output a valve opening setting command to set the opening of the valve of the discharge valve mechanism, the valve mechanism control device is also configured to output the valve opening setting command to set the opening of the valve of the discharge valve mechanism so as to be in inverse proportion to the target pressure in the chamber in which the fluid pressure is adjusted by the choke valve device, and to output the control command to open the valve of the discharge valve mechanism when the target pressure is smaller than the actual pressure, and to output the control command to close the valve of the discharge valve mechanism when the target pressure reaches the actual pressure, and the discharge valve mechanism includes:

two or more kinds of open/close valves connected in parallel to each other, one of the open/close valves having a discharge path of the smallest cross-sectional area among the open/close valves, the remaining open/close valves respectively having a different cross-sectional area calculated by multiplying the smallest cross-sectional area by a power of a base number larger than one; and valve selection control means for selecting a combination of the open/close valves from among the two or more open/close valves in accordance with the valve opening setting command at the time of discharging so that a summation of the cross-sectional areas of the discharge paths of the selected valves may be the closest to a target cross-sectional area, and controlling the selected open/close valves when the control command is inputted.

7. The actuator using a fluid cylinder according to claim 6, wherein the base number larger than one is two.

* * * * *